US008875927B2

(12) United States Patent
Pohlman et al.

(10) Patent No.: US 8,875,927 B2
(45) Date of Patent: Nov. 4, 2014

(54) CONTAINER WITH SELF-VENTING FEATURES

(75) Inventors: Mike Pohlman, Valley Park, MO (US); Tim Cimmerer, Paragould, AR (US)

(73) Assignee: Anchor Packaging, Inc., St. Louis, MO (US)

( * ) Notice: Subject to any disclaimer, the term of this patent is extended or adjusted under 35 U.S.C. 154(b) by 389 days.

(21) Appl. No.: 12/565,515

(22) Filed: Sep. 23, 2009

(65) Prior Publication Data

US 2011/0068105 A1 Mar. 24, 2011

(51) Int. Cl.
*B65D 41/18* (2006.01)

(52) U.S. Cl.
USPC ..... 220/366.1; 220/203.09; 220/203.11; 220/799

(58) Field of Classification Search
USPC ..... 220/799, 796, 366.1, 203.1, 203.2, 220/203.9, 203.11, 203.29, 203.01, 203.02, 220/203.09
See application file for complete search history.

(56) References Cited

U.S. PATENT DOCUMENTS

| | | | | |
|---|---|---|---|---|
| 5,894,953 | A | 4/1999 | Ramirez | |
| 6,170,696 | B1 | 1/2001 | Tucker et al. | |
| 6,372,273 | B1 * | 4/2002 | Mabry et al. | 426/129 |
| 6,467,647 | B1 | 10/2002 | Tucker et al. | |
| 6,910,599 | B2 | 6/2005 | Tucker et al. | |
| 7,017,775 | B2 * | 3/2006 | Zettle et al. | 220/781 |
| 7,097,063 | B2 | 8/2006 | Tucker et al. | |
| 7,097,066 | B2 | 8/2006 | Tucker et al. | |
| 7,261,219 | B2 | 8/2007 | Tucker et al. | |
| 7,314,146 | B2 | 1/2008 | Mavin | |
| 7,357,272 | B2 * | 4/2008 | Maxwell | 220/785 |
| 2003/0155354 | A1 | 8/2003 | Tucker | |
| 2005/0199639 | A1 | 9/2005 | Tucker et al. | |
| 2005/0224498 | A1 | 10/2005 | Savicki | |
| 2005/0269319 | A1 * | 12/2005 | Tang | 220/4.21 |
| 2006/0186014 | A1 | 8/2006 | Ramanujam et al. | |

(Continued)

FOREIGN PATENT DOCUMENTS

| | | | |
|---|---|---|---|
| WO | WO 2006/091471 | A2 | 8/2006 |
| WO | WO 2006/091655 | A1 | 8/2006 |

(Continued)

OTHER PUBLICATIONS

International Search Report and Written Opinion for PCT/US 10/01342, dated Jun. 6, 2010.

(Continued)

*Primary Examiner* — Stephen Castellano
(74) *Attorney, Agent, or Firm* — Don V. Kelly; Evans & Dixon, L.L.C.

(57) ABSTRACT

A container includes a lid adapted to seal with a base. The lid and base rims each have vertical segments that mate upon sealing the container. The mating segments form a vertical seal zone. The vertical seal zone has a width extending across the rim surfaces. One or more vent channels are disposed on either or both rims. Each vent channel extends partially into the vertical seal zone. When pressure inside the container reaches a critical level, the lid rises and reduces the width of the seal zone, creating a vent point. Pressurized vapors traveling through the vent channel overcome rim-engaging forces at the vent point and pass through the engaged rims. Once pressure is purged, the lid descends and resumes its sealed arrangement with the base. The rims may respectively include horizontally oriented segments that engage each other to from a horizontal seal zone.

13 Claims, 16 Drawing Sheets

(56) References Cited

U.S. PATENT DOCUMENTS

| | | | |
|---|---|---|---|
| 2007/0007298 | A1 | 1/2007 | Tucker et al. |
| 2007/0119743 | A1 | 5/2007 | Tucker |
| 2008/0041850 | A1 | 2/2008 | Tucker |
| 2008/0197134 | A1 | 8/2008 | Maxwell |
| 2008/0203096 | A1 | 8/2008 | Maxwell |
| 2009/0000977 | A1 | 1/2009 | Coonce |

FOREIGN PATENT DOCUMENTS

| | | | |
|---|---|---|---|
| WO | WO 2006/091663 | A2 | 8/2006 |
| WO | WO 2007/001748 | A1 | 1/2007 |
| WO | WO 2007/001749 | A1 | 1/2007 |
| WO | WO 2007/084889 | A2 | 7/2007 |
| WO | WO 2007/084892 | A2 | 7/2007 |
| WO | WO 2007/106676 | A2 | 9/2007 |
| WO | WO 2007/143308 | A2 | 12/2007 |
| WO | WO 2008/002726 | A2 | 1/2008 |

OTHER PUBLICATIONS

International Preliminary Report on Patentability in co-pending PCT Application No. PCT/US2010/01342, Date Apr. 5, 2012.

Notice of Allowance received from Taiwan Intellectual Property Office co-pending Taiwan Patent Application No. 099122952, Date: May 16, 2013.

Preliminary Examination Report received from Taiwan Intellectual Property Office in co-pending Taiwan Patent Application No. 099122952.

Notice of Allowance received from Canadian Intellectual Property Office in co-pending Canadian Patent Application No. 2,765,675, Date: Sep. 16, 2013.

* cited by examiner

CONTAINER WITH SELF-VENTING FEATURES

CROSS REFERENCE TO RELATED APPLICATION

Not Applicable.

STATEMENT REGARDING FEDERALLY SPONSORED RESEARCH OR DEVELOPMENT

Not applicable.

SEQUENCE LISTING, TABLE OR COMPUTER PROGRAM ON COMPACT DISC

Not applicable.

FIELD OF INVENTION

This invention relates generally to vented plastic food containers. The invention is more specifically related to disposable plastic food containers with through-the-rim steam release mechanisms.

BACKGROUND OF THE INVENTION

It is known to use disposable plastic containers to store microwaveable foods. The typical food container of the prior art consists of a clear or solid color base and a clear lid. The clear lid of the prior art plastic food container allows visible inspection of the container contents. The lid and base of the prior art plastic food container may be separate articles or may be hingedly attached to each other.

The lid and base of the prior art plastic container have complementary interlocking rim structures that seal the container. This interlocking rim arrangement is essential in preventing leakage and spillage of food contents from the container. In addition, this interlocking rim arrangement promotes heat build-up inside the container during microwaving or retains the temperature of hot foods placed in the container. When hot foods are placed or cooked in the container, high pressures can develop inside the container. Such high steam pressures can pose a hazard to consumers should the lid be purposefully or inadvertently opened. Additionally, if the pressure builds up sufficiently, it can cause the lid to explosively separate from the base. This explosive separation can, in turn, cause the sudden ejection of hot and messy food contents.

The solution to preventing excessive steam build-up is not simply a case of providing the container lid with vents. In this regard, the lid of some prior art plastic food containers may contain top surface holes or vents. Often the vents are in the form of cruciate slits. The cruciate slits form near-circular tabs that can be deformed upward to permit egress of steam formed inside the container. Though these slits assist in the venting of steam gases from the container, they also permit the leakage or spillage of food contents should the container tip or turn over. They also allow the ingress of bacteria into the container.

To eliminate the problems associated with slit venting, some manufacturers have provided one of the rim structures (usually that of the lid) with transverse channels that allow steam to escape through the channels when the lid rim and base rim are engaged. These channels create a permanent discontinuity in the seal between the lid rim and base rim. Liquid food contents can pass through these channels when the container is tipped. Accordingly, the problem with these types of rim egress channels is that the container is not leak resistant.

Other container manufacturers have designed containers that eliminate excess steam pressure via a two-position, lid rim and base rim engagement mechanism. In the first position, the lid rim and base rim engage, sealing the container. In the second position, the lid rim and base rim assume an orientation under which steam may vent through the rims. In the case of these latter containers, the sealed lid assumes its venting position on the base either through manual repositioning or by the lifting action of rising pressure inside the container. Once the lid is in the venting position, steam can escape the container by flowing through the rim structures and out through the container. The drawback to these prior art venting solutions is that once the lid is positioned in or assumes its secondary venting position on the base, the container is only loosely closed and no longer leak resistant. There is thus a need in the art for a plastic food container that allows for the venting of steam pressure, but restores itself to a leak resistant state once excess steam is purged from the container.

SUMMARY OF THE INVENTION

The present invention satisfies the need in the art and provides an aesthetically appealing food container that is easy to use, while providing for removal of excessive steam pressure. In this respect the present invention plastic food container comprises a lid adapted for sealing arrangement with a base. The lid has a perimeter rim structure that complementarily engages the rim structure of the base to achieve a leak resistant seal. The base has a floor and a sidewall extending between the floor and the base rim. In the preferred embodiment, the lid rim comprises an inner wall (that descends in relation to the lid top), a horizontally oriented, peripherally projecting segment and a vertically oriented segment (outer wall). The lid rim may also include a peripherally projecting outer flange. The inner wall, peripherally projecting segment and outer wall form a retaining bead that descends downwardly and snap fits within and is frictionally held by the vertically oriented inner wall of the base rim structure. The base rim structure comprises a vertically oriented segment (an inner wall that ascends in relation to the container floor) and a horizontally oriented, peripherally projecting segment (transition segment). The base rim may also include a descending outer wall and an peripherally projecting outer flange.

As noted, the outer wall of the lid rim and inner wall of the base rim are vertically oriented segments. Each of these vertically oriented segments has a mating surface complementary to the other. These mating surfaces are adapted for complementary engagement with each other when the container is in the sealed arrangement. In this sealed arrangement, the mating surfaces of the vertically oriented segments define a vertical seal zone. The vertical seal zone has a width that extends upwards in relation to the floor of the container. The invention includes one or more vent channels disposed on the lid rim or base rim. In the preferred embodiment, the one or more vent channels are disposed on the lid rim. The one or more vent channels define an area of partial discontinuity across the width of the vertical seal zone.

The lid of the present invention container is adapted to remain engaged to the base, but allow the egress of gases and vapors inside the sealed container through the one or more vent channels upon the pressure in the sealed container reaching a certain level. Importantly, each vent channel extends upward from the peripherally projecting segment for only a portion of the outer wall of the lid rim (preferred embodiment example) or the inner wall of the base rim. Hence, in the sealed state, the vent channel defines an area of partial discontinuity of the width of the vertical seal zone area between the lid rim and base rim. Hence, in the normally sealed state, the continuous portion of the vertical seal zone provides a leak resistant seal. However, when the container's interior pressure reaches a certain level, that pressure raises the lid. This rising action shortens the vertical seal zone. Steam travels through the vent channels and reaches the shortened vertical seal zone. Via its pressure the steam can breach the shortened seal zone and travel through the remaining rim structures and out of the container. The one or more vent channels of the present invention container may be disposed on the lid rim, the base rim or both.

The leak resistance and venting capability of the present invention container can be enhanced by having the horizontally oriented, peripherally projecting segments of the lid rim and base rim engage during sealing. Thus, in the preferred embodiment of the invention, the horizontally oriented, peripherally projecting segments of the base rim and lid rim each have a mating surface. These mating surfaces are also adapted for complementary engagement with each other when the container is in the sealed arrangement. In this arrangement, the mating surfaces of the horizontally oriented, peripherally projecting segments define a horizontal seal zone. Hence, the preferred embodiment container comprises both vertical and horizontal seal zones.

When the preferred embodiment container is sealed, the outer wall of the lid rim presses outwardly against the inwardly canted inner wall of the base rim. Portions of the inner wall of the base rim and the outer wall of the lid rim contact each other and form the vertical seal zone. The horizontally, oriented, peripherally projecting segment of the lid rim contacts and seals against the horizontally oriented, peripherally projecting transition segment of the base rim and creates the horizontal seal zone between the rims. The horizontal seal zone has a width extending in a direction transverse to the circumference (round containers) or perimeter (polygonal containers) of the base rim and lid rim. Hence, in the normally sealed state, the mating rim surfaces of the horizontal seal zone and the vertical seal zone provide a leak resistant seal. When the container's interior pressure reaches a certain level, that pressure raises the lid thus completely breaking the horizontal seal zone and shortening the vertical seal zone.

In the preferred embodiment container each vent channel is disposed on the horizontally oriented, peripherally projecting segment and the outer wall of the lid rim. When disposed in this fashion, the one or more vent channels define an area of complete discontinuity across the width of the horizontal seal zone. The one or more vent channels may also be disposed on the base rim. In the case where the container includes a plurality of vent channels, the plurality of vent channels may be positioned so that they are equally spaced on either or both of the lid rim or base rim. The vent channels may also be positioned on and divided among both rims, so that when the lid rim and base rim are engaged, the vent channels are equally spaced around the periphery of the container.

The frictional fit between the lid and base prevent the lid and base from fully disengaging from each other due to internal pressure. Other lid retention features are possible. For example, the lid rim may be formed with a protrusion such as will catch a complementary protrusion or overhang on the base rim so as to prevent the lid from fully disengaging from the base. Once steam gases are purged and the interior pressure drops below the critical level, the lid rim automatically resumes its normal leak resistant arrangement on the base rim. The lid of the present invention container may be configured to not just rise in relation to the base when under pressure but also to flex so as to modulate the steam pressure required to breach the shortened transverse seal zone. For example, this flexing can deform the lid rim to base rim vertical contact area such that sealing force along the shortened transverse seal zone is strengthened or weakened. In contrast to prior art containers utilizing two position through-the-rim-venting, the present invention does not require manual manipulation to purge steam or replace the lid into a sealed arrangement with the base after the container has been vented.

DETAILED DESCRIPTION

Figure 1:
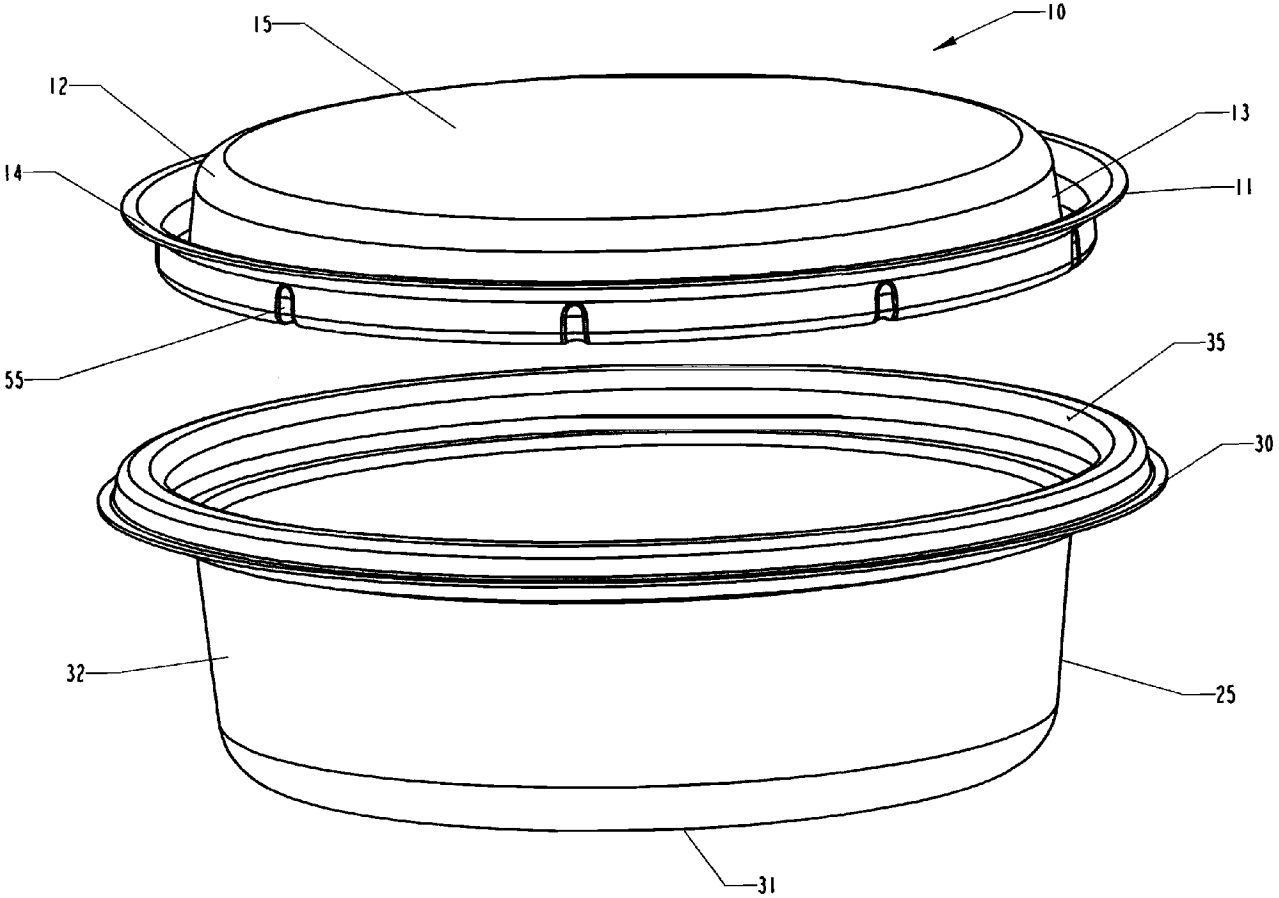
FIG. 1 is an exploded perspective view of a preferred embodiment of the present invention container in the open arrangement.
Figure 2:
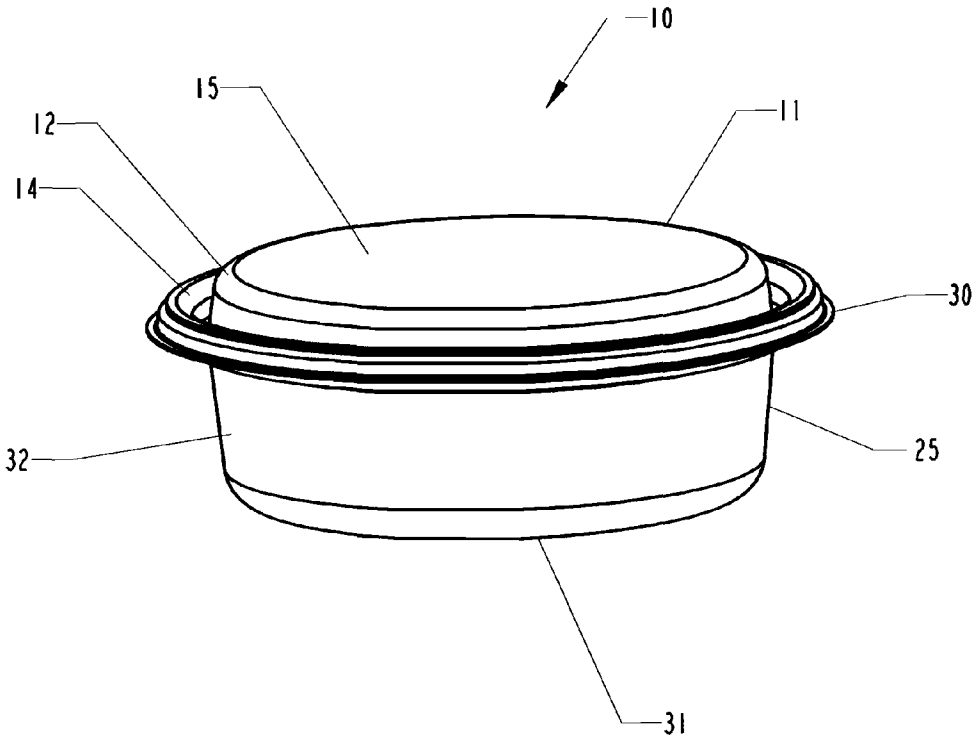
FIG. 2 is a perspective view of a preferred embodiment of the present invention container in the sealed arrangement.
Figure 3:
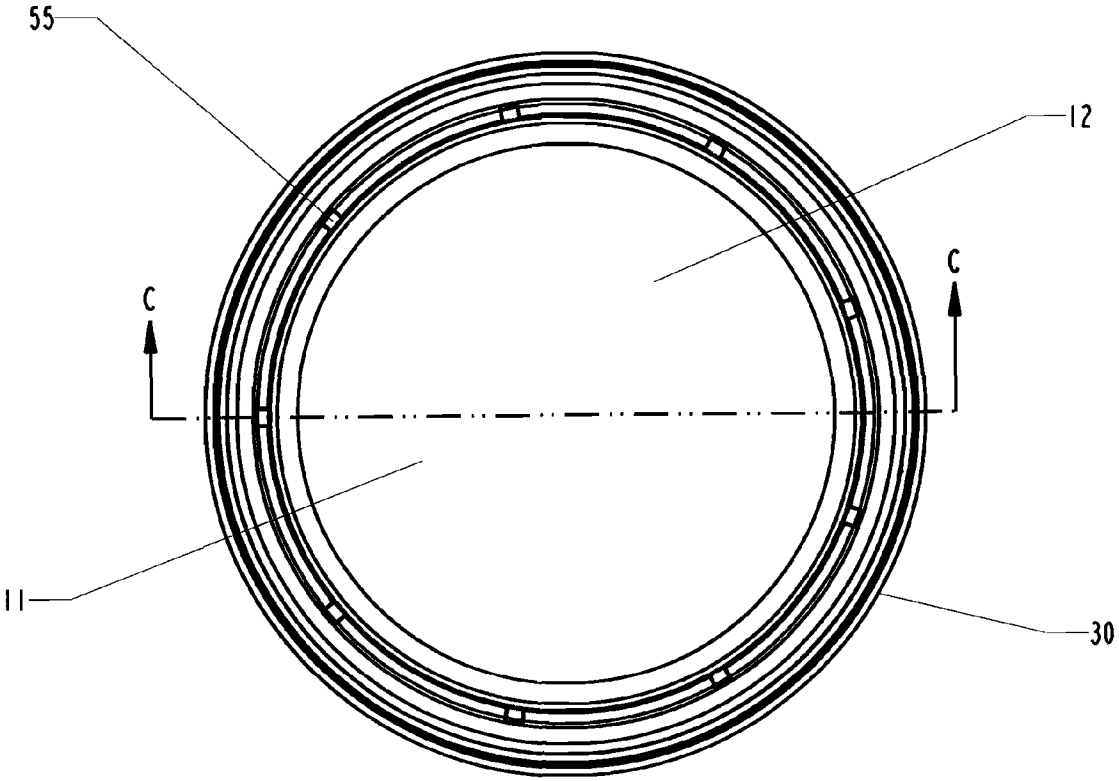
FIG. 3 is a plan view of the present invention container in the sealed arrangement.
Figure 4:
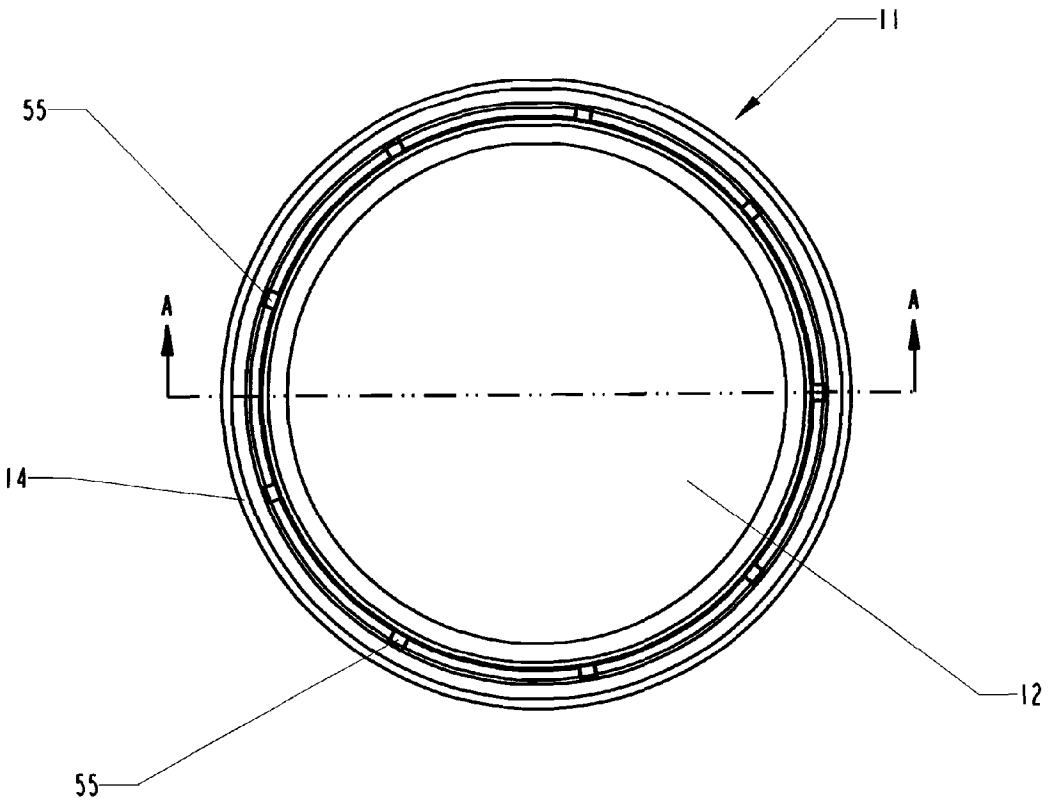
FIG. 4 is a plan view of the exterior of the lid of the present invention container.

A preferred embodiment container 10 of the present invention in the open and sealed arrangement is shown in FIGS. 1 and 2. The container is preferably thermoformed. As shown by these figures, container 10 is composed of lid 11 and base 25. Lid 11 includes upper portion 12, which curves and descends to form inner wall 13 of multi-segment rim 14. Lid 11 and base 25 are manufactured from a conventional plastic material. Lid 11 is preferably clear. Upper portion 12 may be flat, but may include contours or ribs in accordance with the prior art to enhance such factors as container volume, strength, nesting of multiple lids, stackability of sealed containers and see-through visibility. In the preferred embodiment lid upper portion 12 includes top plateau 15.

Figure 10:
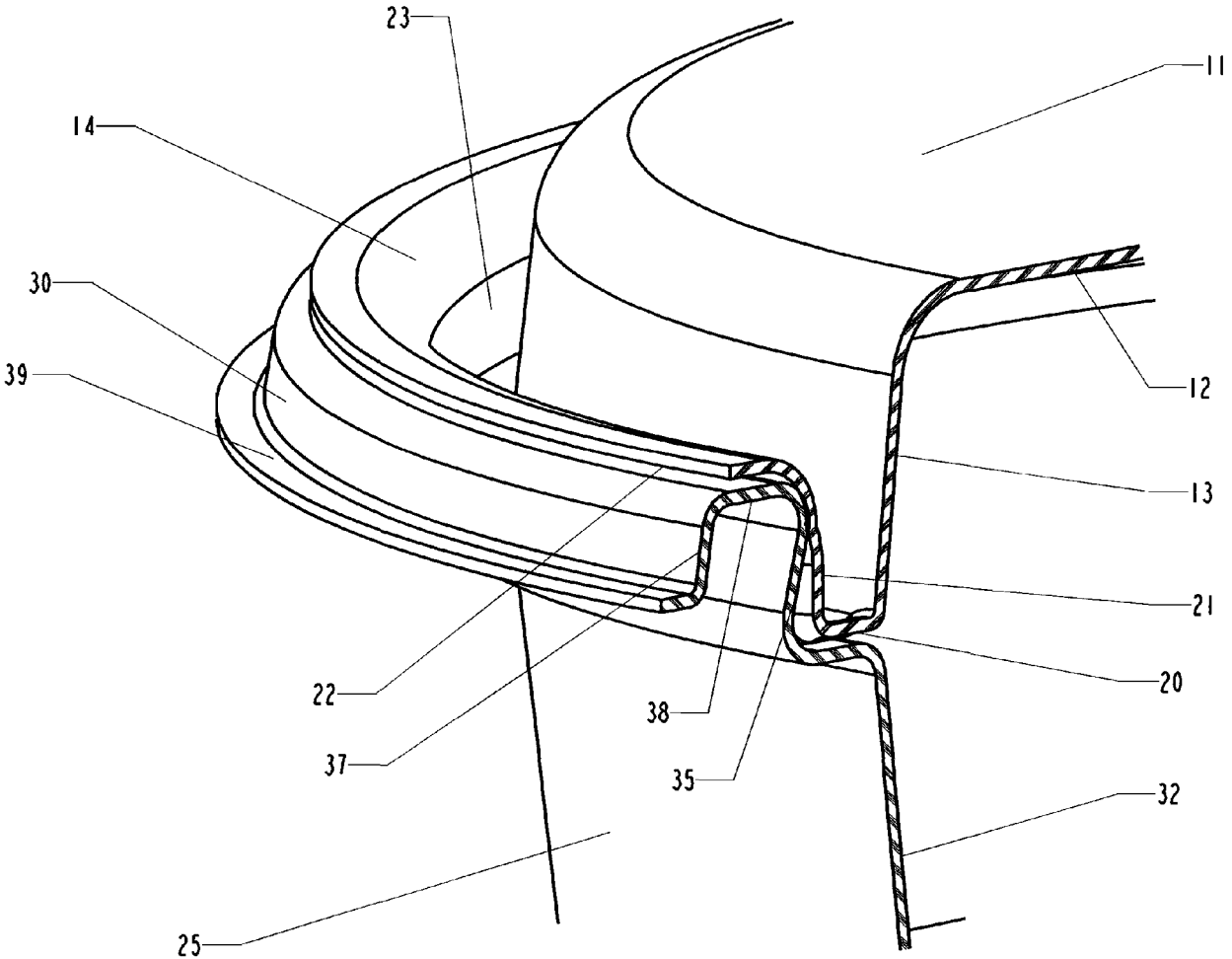
FIG. 10 is a fragmentary perspective view of the engaged lid and base rims of the preferred embodiment present invention container showing a vent channel.
Figure 11:
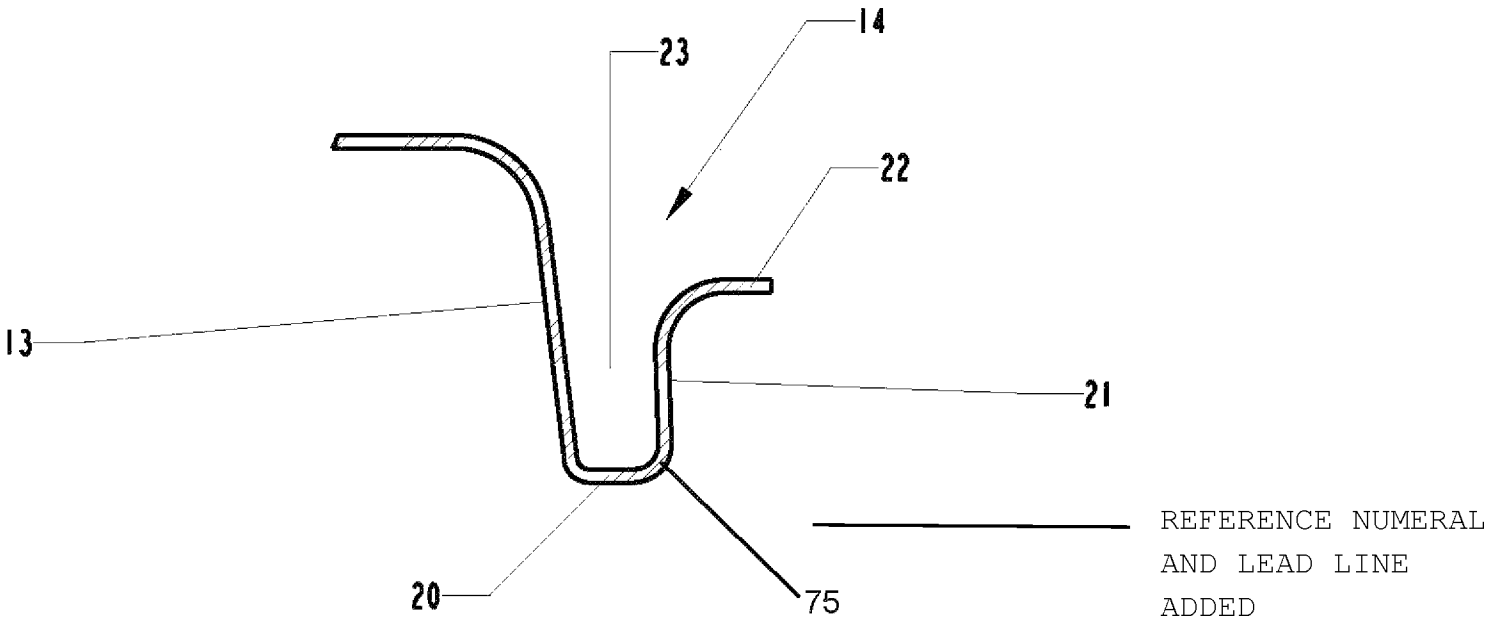
FIG. 11 is an enlarged view of detail area Z of FIG. 6.

The structure of preferred embodiment lid rim 14 will now be discussed in further detail. As shown in FIG. 10 and FIG. 11, lid rim 14 includes horizontally oriented, peripherally projecting segment 20, which extends between inner wall 13 and vertically oriented outer wall 21, creating channel 23. The cross-section profile of segment 20 is generally flat. The profile, however, can be shaped to include structure such as ribbing, curves or bends to modulate rim strength, rigidity or flexibility so as to enhance the closing, sealing and opening functions of the rim as needed. The drawings depict a preferred embodiment cross-section profile of this horizontally oriented, peripherally projecting segment. As shown in FIG. 10 and FIG. 11, outer wall 21 extends vertically between peripherally projecting segment 20 and peripheral flange 22. Vertically oriented outer wall 21 is preferably canted to better frictionally engage vertically oriented inner wall 35 of base rim 30 further described below. The inner wall 13, peripherally projecting segment 20 and outer wall 21 form a retaining bead 75 that descends downwardly and snap fits within and is frictionally held by the vertically oriented inner wall 35 of the base rim structure.

Lid rim 14 further comprises one or more vent channels 55. In the preferred embodiment vent channels 55 are formed in peripherally projecting segment 20 and outer wall 21. In the preferred embodiment, vent channels 55 extend the length of segment 20. For the reasons described below vent channels 55 extend only a portion up outer wall 21.

Figure 5:
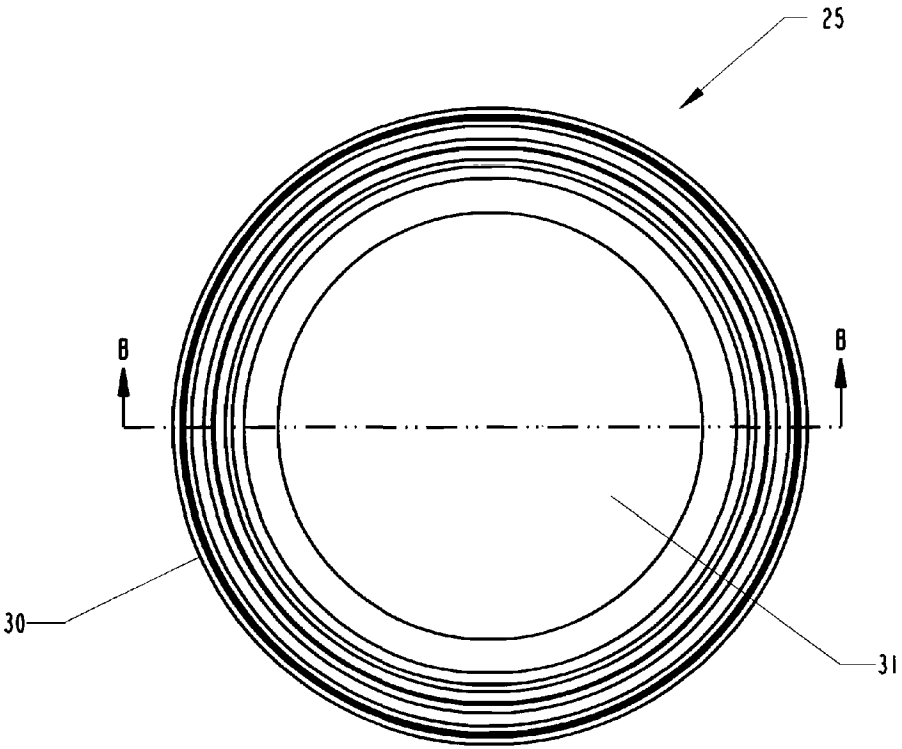
FIG. 5 is a plan view of the interior of the base of the present invention container.
Figure 6:
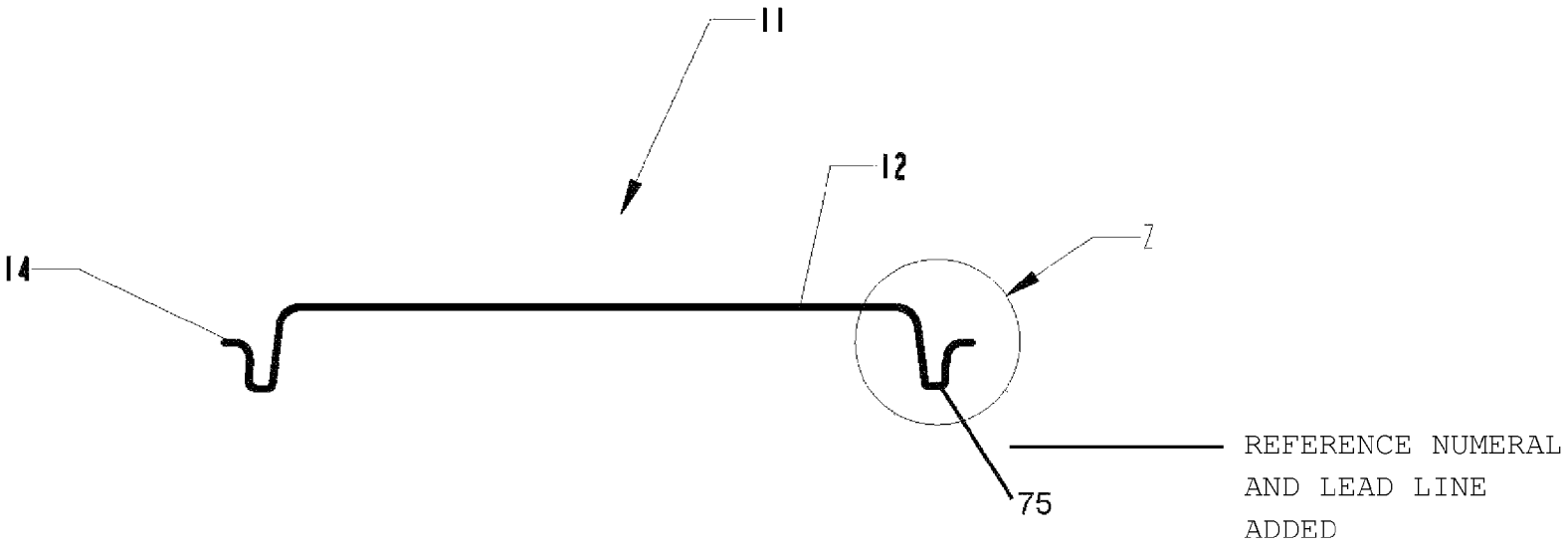
FIG. 6 is a cross-section view taken along line A-A of FIG. 4.
Figure 7:
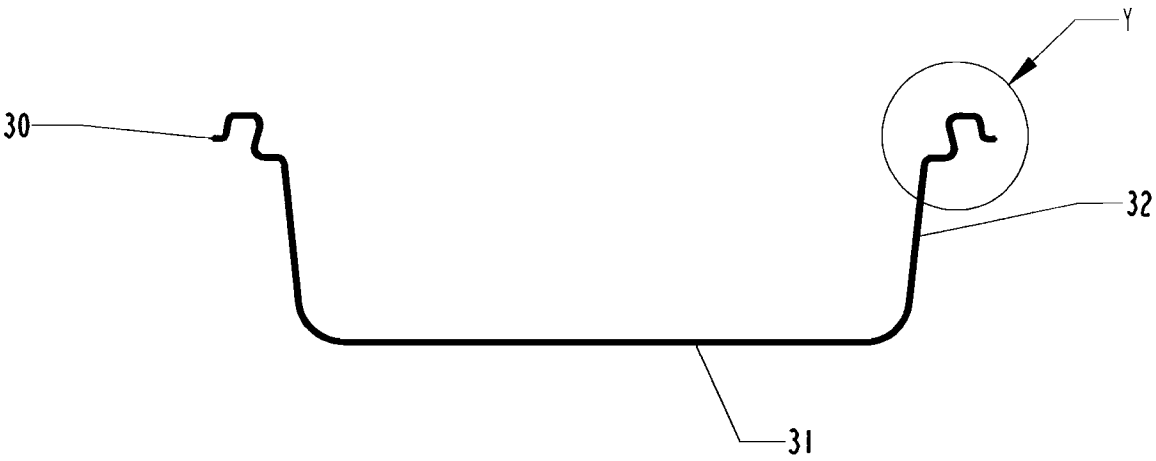
FIG. 7 is a cross-section view taken along line B-B of FIG. 5.
Figure 8:
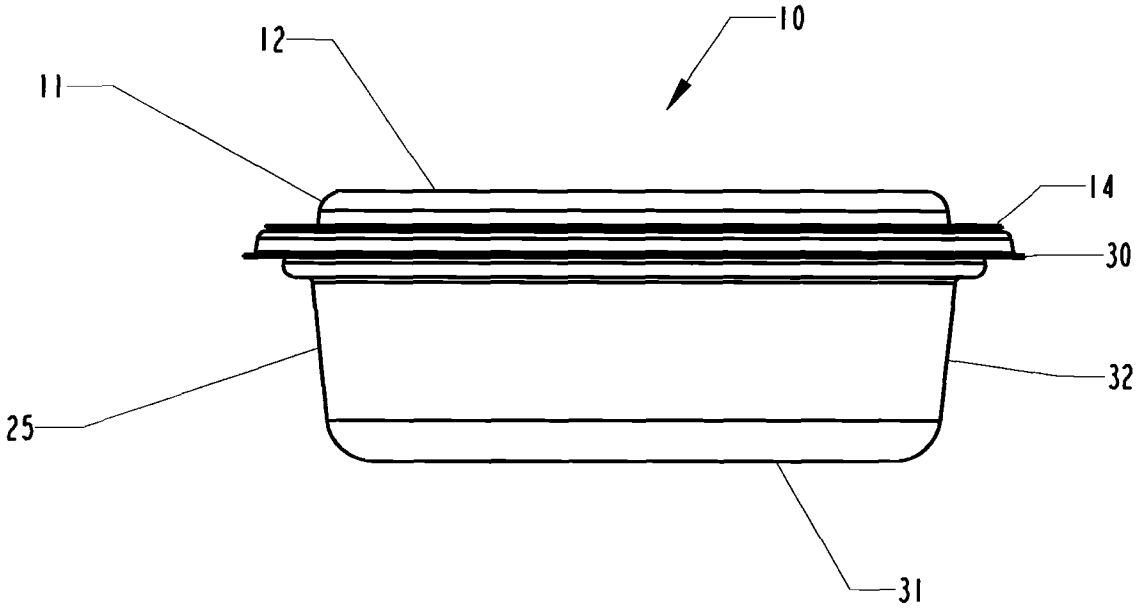
FIG. 8 is a side elevation view of the preferred embodiment present invention container in the sealed arrangement.
Figure 9:
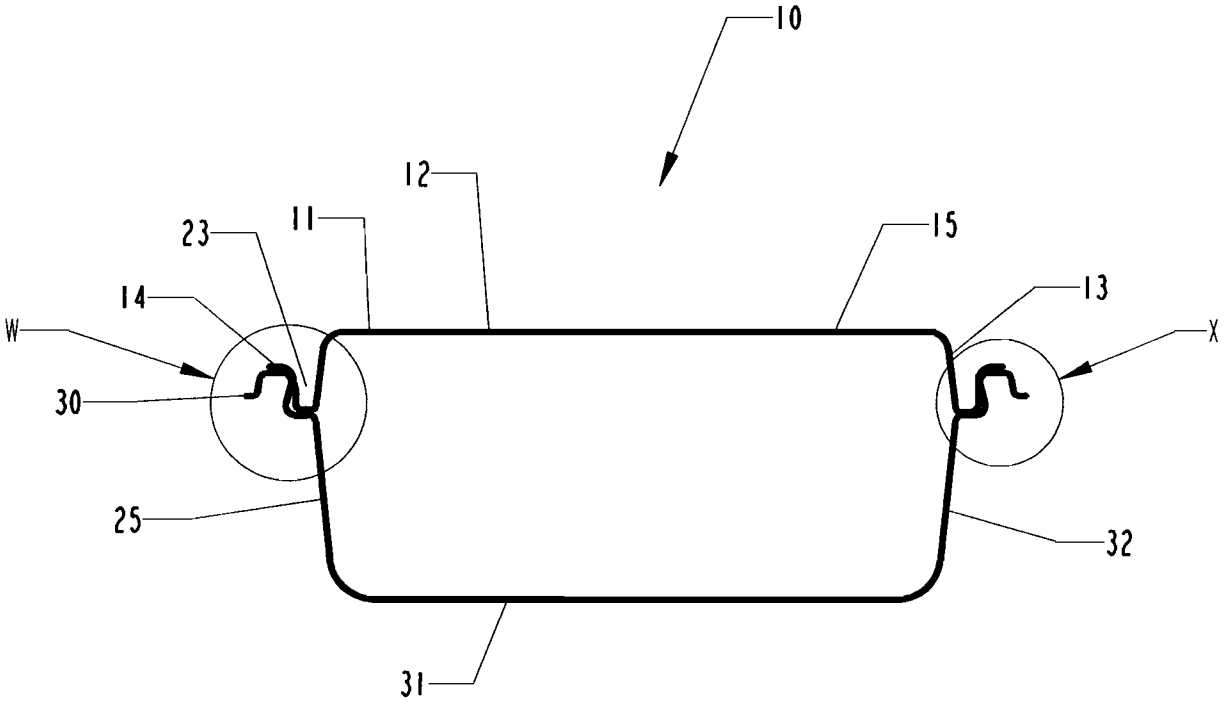
FIG. 9 is a cross-section view taken along line C-C of FIG. 3.

Base 25 includes a bottom-most level or floor 31 adjoined to sidewall 32. Sidewall 32 extends between base floor 31 and multi-segment rim 30. Sidewall 32 may include ribs for strength. Rim 30 includes vertically oriented segment (inner wall) 35, which is adapted to frictionally engage vertically oriented segment (outer wall) 21 of lid rim 14 when lid 11 and base 25 are placed in sealing arrangement. The structure of preferred embodiment base 25 is shown in FIG. 5, FIG. 7 and FIG. 8.

Figure 12:
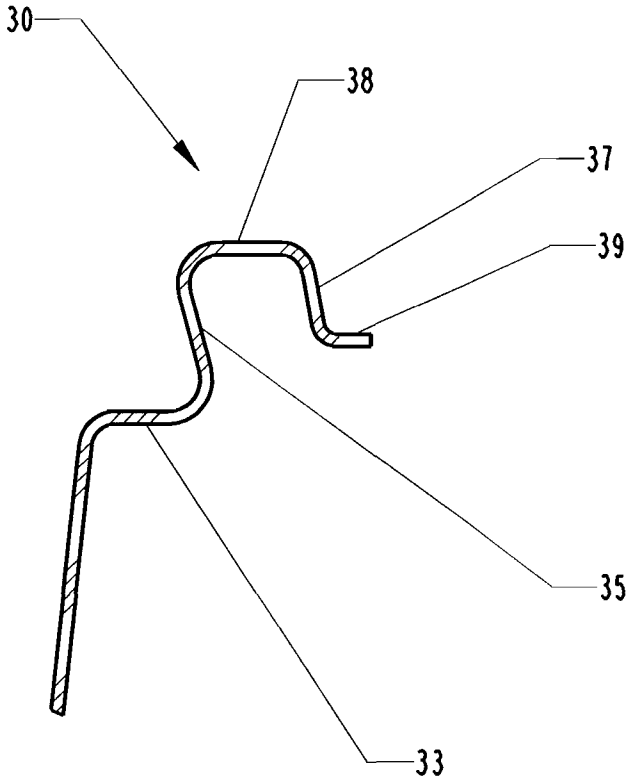
FIG. 12 is an enlarged view of detail area Y of FIG. 7.

The structure of base rim 30 is shown in FIG. 10 and FIG. 12. Base rim 30 includes sidewall-to-rim transition segment 33. Transition segment 33 is horizontally oriented and peripherally projecting. Transition segment 33 peripherally projects from the top of sidewall 32 and curves upwardly into inner wall 35. Inner wall 35 extends upwardly from transition segment 33 to form top horizontal segment 38. Preferably, inner wall 35 is canted to provide maximum frictional engagement against outer wall 21. As viewed in FIG. 10 and FIG. 12, top horizontal segment 38 spans between inner wall 35 and outer wall 37. Rim 30 may include peripheral flange 39, extending outwardly from base 25 from the bottom of outer wall 37.

Figure 13A:
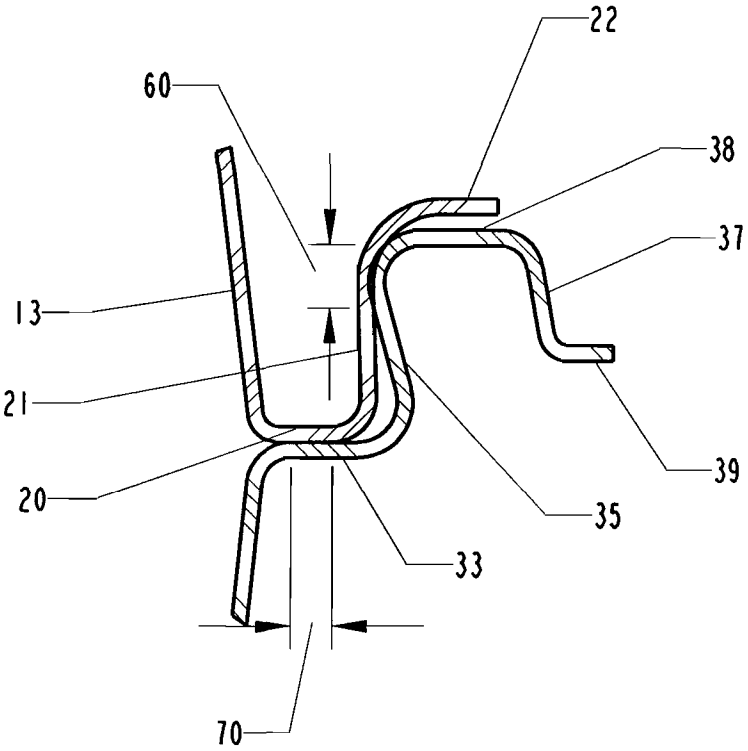
FIG. 13A is an enlarged view of detail area X of FIG. 9 showing the mechanism of engagement between the lid rim and base rim at a point where there is no vent channel and showing the seal zones created by the mating surfaces of the sealed rims.
Figure 13B:
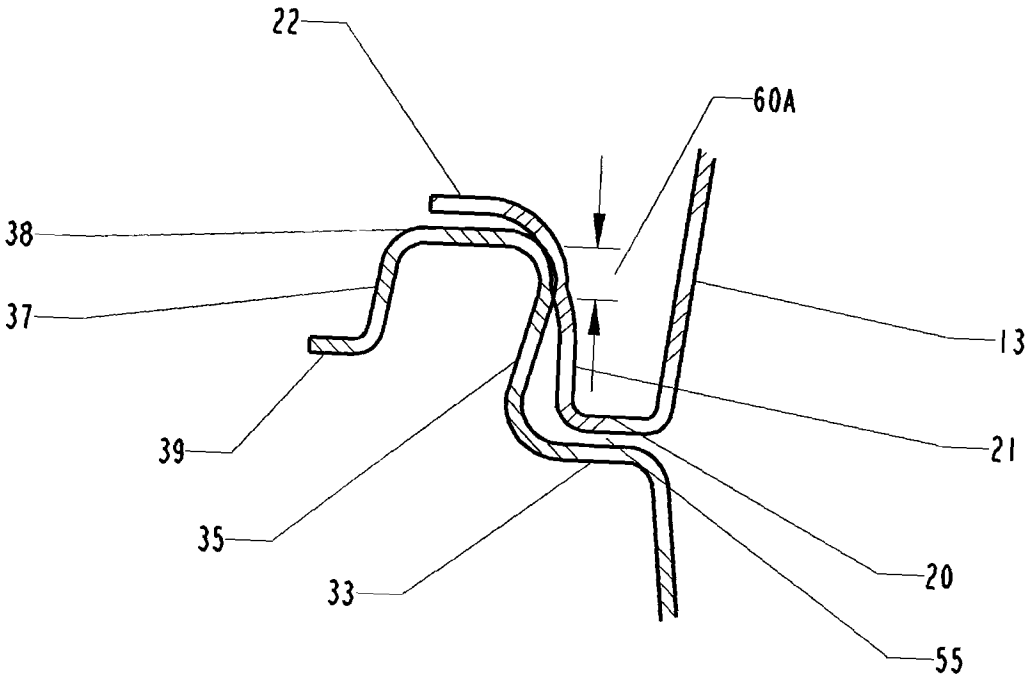
FIG. 13B is an enlarged view of detail area W of FIG. 9 showing the sealing arrangement between the lid rim and base rim at a point including a vent channel.

FIG. 13A shows the sealing arrangement between the lid rim and base rim at a point where there is no vent channel. FIG. 13B shows the sealing arrangement between the lid rim and base rim at a point where there is a vent channel. As seen in these drawings, vertically oriented outer wall 21 of the lid rim 14 frictionally engages vertically oriented inner wall 35 of the base rim 30. In the area where there is no vent channel 55, the mating portions of segments 21 and 35 create a vertical seal zone 60. In the area where there is a vent channel, the mating portions of segments 21 and 35 create vertical seal zone 60A. Seal zone 60A constitutes the upper portion of seal zone 60 (the part above the one or more vent channels 55). Seal zone 60A is continuous in that it is not broken by the intrusion of a vent channel. The lower portion of seal zone 60 (the part into which the one or more vent channels 55 intrude) is discontinuous in that it is broken by the intrusion of a vent channel. The width of vertical seal zone 60 preferably extends in a direction generally transverse to the peripherally projecting structures of the base rim and lid rim.

In the shown preferred embodiment (best seen in FIG. 13B), vent channel 55 extends fully across the length of segment 20. Therefore, a horizontal discontinuous seal zone 70 is formed where the surfaces of horizontally oriented, peripherally projecting segments 20 and segment 33 contact each other. Preferably, the horizontal seal zone has a width extending in a direction radially or peripherally outward from the center of the container through its side and generally parallel to the horizontal surfaces (such as floor 31) of the container.

Figure 14A:
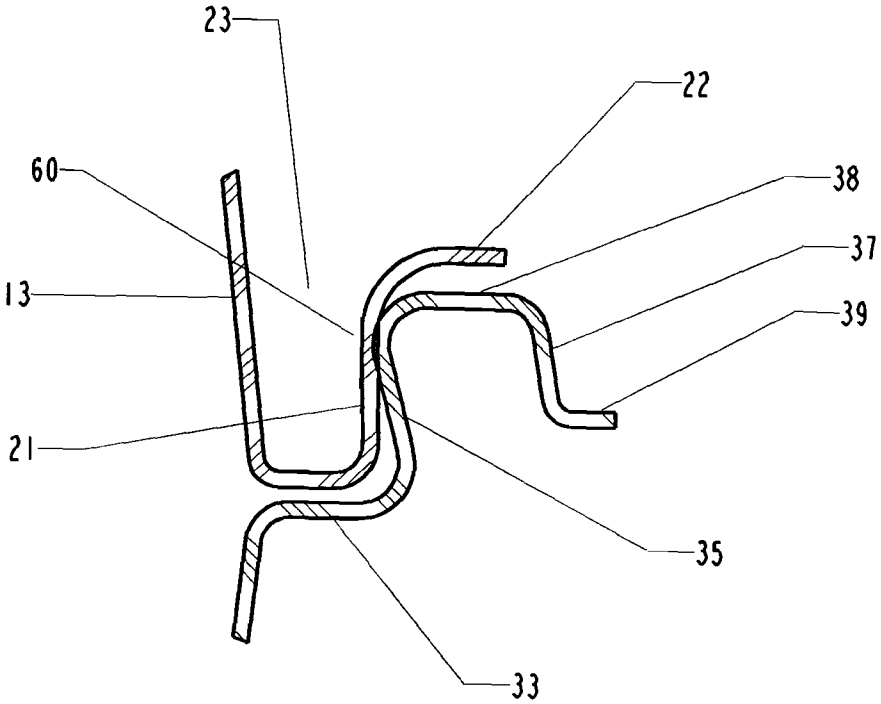
FIG. 14A is an enlarged view of detail area X of FIG. 9 showing the arrangement of the engaged rim structures of the lid and base at a point where there is no vent channel and when the container is under pressure created by heated foods inside the sealed container.

FIG. 14*a* depicts the arrangement of the engaged rim structures at a location where there is no vent channel and the container is under internal pressure. As seen in this drawing, when critical internal pressure is reached, lid rim 14 rises on base rim 30. This rising action shortens the width of, but does not eliminate, the continuous seal zone 60 at the mating surfaces between outer wall 21 and inner wall 35. In this pressurized state, the pressure behind steam flowing between the rim surfaces is not sufficient to overcome the frictional engagement force of outer wall 21 against inner wall 35 at the shortened seal zone 60.

As noted, in the preferred embodiment, horizontal seal zone 70 is discontinuous by virtue of the one or more vent channels 55 being disposed fully across segment 20. However, the length of vent channel 55 along outer wall 21 is such so as extend only partially into and not fully across seal zone 60 between walls 21 and 35. Hence, the portion 60A of vertical seal zone 60 is continuous. FIG. 13B shows the sealing arrangement between the lid rim and base rim at a point where there is a vent channel. As seen in this drawing, outer wall 21 of lid rim 14 frictionally engages inner wall 35 of the base rim 30. The mating portions of walls 21 and 35 create a continuous vertical seal zone 60A, which represents a portion of seal zone 60. At the point where the rims engage and there is a vent channel 55, there is no horizontal seal zone 70.

Figure 14B:
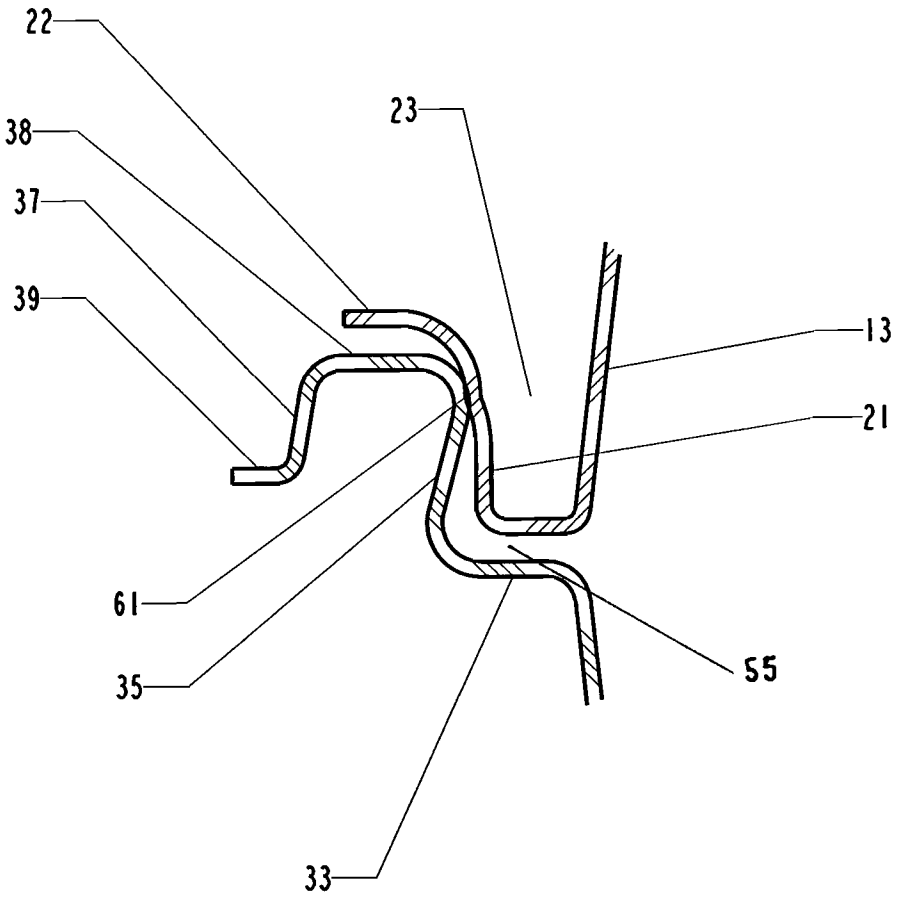
FIG. 14B is an enlarged view of detail area W of FIG. 9 showing the arrangement of the engaged rim structures of the lid and base at a point including a vent channel and when the container is under pressure created by heated foods inside the sealed container.
Figure 6:
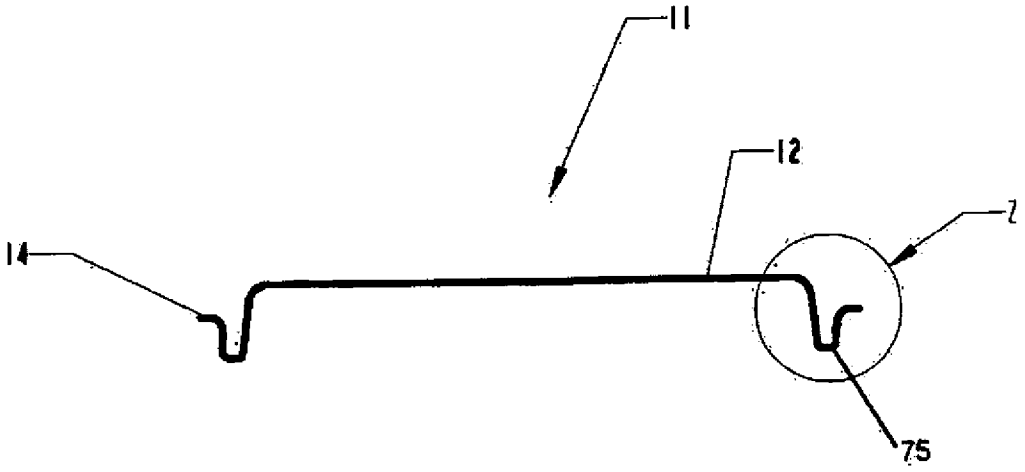
Figure 11:
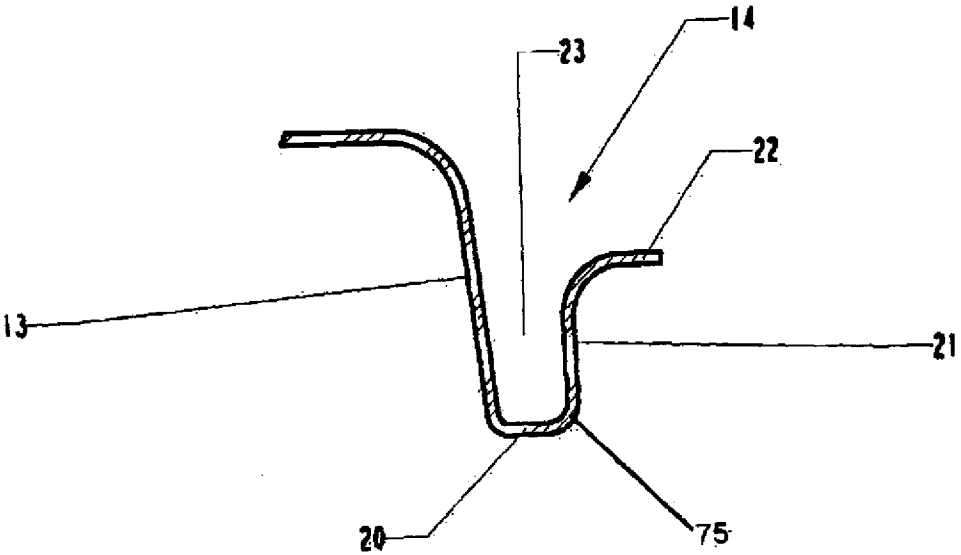
Figure 6:
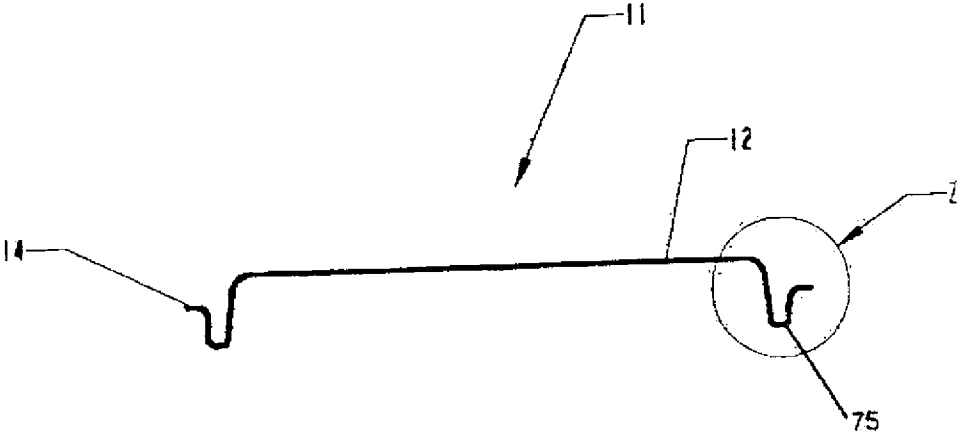
Figure 11:
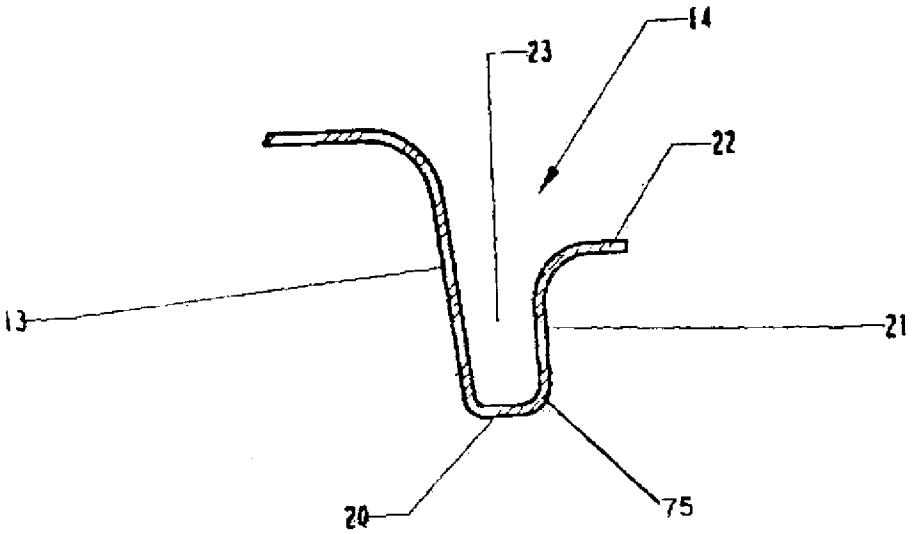

FIG. 14B depicts the arrangement of the engaged rim structures at the location of a vent channel when the container is under internal pressure. When critical internal pressure is reached, lid rim 14 rises on base rim 30. As seen in FIG. 14B, this rising action significantly shortens the width of seal zone 60A so as to create vent point 61 at the remaining mating surfaces between outer wall 21 and inner wall 35 above vent channel 55. In this pressurized state, the pressure behind steam flowing through vent channel 55 builds up and becomes sufficient to overcome the frictional engagement force of outer wall 21 against inner wall 35 at the vent point 61. Once steam breaches vent point 61 it can easily pass through the remaining adjacent, but spaced-apart, opposing surfaces of lid rim 14 and base rim 30. Once past these opposing surfaces the steam emerges out of the container.

During the steam release phase, lid 11 remains frictionally engaged by base 25 by virtue of their dimensions and the structure of lid rim 14 and base rim 30. Other lid retention or rise-height limiting features are possible. For example, the lid rim may be formed with a protrusion such as will catch a complementary protrusion or overhang on the base rim so as to further protect against the lid from fully disengaging from the base. Regardless of the retention mechanism, once the interior pressure drops below the critical level, lid 11 descends back into base 25 and the rim structures assume their original sealed arrangement, with seal zones restored. However, in contrast to prior art containers with intra-rim venting, the described container assumes its original sealed and leak resistant arrangement without manual intervention.

The venting action of lid 11 on base 25 can be modulated not just by varying the permissible rise height of rim 14 relative to rim 30, but also by varying the flexing action of lid 14 under pressure. In this regard, lid 11 can be provided with ribs or thinning so as to promote or restrict the canting of rim 14 on rim 30 under pressure. By varying the lid in such fashion, both the length of the shortened transverse seal zone and the engaging pressure at the vent point can be varied.

In carrying out the invention it is not important which rim, lid or base, is provided with the venting channels 55. Accordingly, in another embodiment, inner wall 35 of base rim 30 could be provided with venting channels 55 and outer wall 21 of lid rim 14 could be smooth. In fact, other rim engaging methods could be used as long as the sealing rim structures of the lid and base include one or more vent channels 55 that only partially extend across the vertical seal zone of the mating rim structures and the rising and/or flexing action caused by internal pressure creates a vent point that may be overcome by a critical pressure level in the container. The orientation of vent channels 55 may also modulated along the horizontal and vertical rim segments of the container. In this regard, instead of extending directly radially outward in the case of a round container, at least one of the one or more vent channels can be formed as a partial spiral structure on horizontally oriented segments 20, 33 of the lid rim or base rim. In the case of a polygonal container, instead of projecting normally outward from a side of the container, at least one of the one or more vent channels can be formed as a diagonally oriented channel on horizontally oriented segments 20, 33 of the lid rim or base rim. Likewise, instead of projecting normally upward from the horizontally oriented segments, the vent channels may be angled on the vertically oriented segments in the case of a polygonal container. In the case of a round container, a vent channel could be helically oriented along segments 21, 35. In this last embodiment, the vent channel 55 of this embodiment would resemble a partial screw thread.

A container constructed in accordance with the present invention can be manufactured in a variety of shapes and sizes, and is preferably formed of resins or plastic materials including, but not limited to, polyethylene, polypropylene, polyvinyl chloride or polyethylene terephthalate ("PET"). The container may be thermoformed, blow-molded or injection molded. The container lid and base can be transparent, translucent, or opaque, and may be colored in any instance. Further, the container can be of any shape, including round or polygonal. The lid and base of the container may be separate articles or may include a hinge such that the lid and base are connected to each other in a clamshell configuration.

Having described the invention in detail, those skilled in the art will appreciate that modifications may be made to the invention without departing from its spirit. Therefore, it is not intended that the scope of the invention be limited to the specific embodiment illustrated and described.

What is claimed is:

1. A plastic food container comprising:

a base and a lid;

the base having a base rim and the lid having a lid rim;

the lid rim forming a downwardly descending retaining bead;

the base rim and lid rim adapted for sealing engagement with each other, the sealing engagement achieved by the downwardly descending retaining bead snap fitting within and being frictionally held by the base rim by virtue of that snap fit;

the base rim and lid rim each having a vertically oriented segment;

the vertically oriented segments of the base rim and lid rim each having a mating surface;

the mating surfaces of the vertically oriented segments adapted for complementary engagement with each other when the container is in sealed engagement;

the mating surfaces when engaged creating a first vertical seal zone extending around the periphery of the container, the first vertical seal zone having a width defined by the engaged mating surfaces when the container is in the sealed arrangement;

one or more vent channels disposed on the lid rim or base rim and extending upwardly and partially into the width of the first vertical seal zone, each of the one or more vent channels defining an area of partial peripheral discontinuity of the first vertical seal zone where the mating surfaces of the vertically oriented segments do not contact each other when the container is in the sealed arrangement;

the mating surfaces when engaged also creating a second vertical seal zone, the second vertical seal zone constituting a portion of the first vertical seal zone; and the second vertical seal zone being continuous about the periphery of the container and being defined by the portion of the width of the first vertical seal zone located above the one or more vent channels.

2. The container of claim 1 further comprising:

the base rim and lid rim each having a horizontally oriented, peripherally projecting segment;

the horizontally oriented, peripherally projecting segments of the base rim and lid rim each having a mating surface;

the mating surfaces of the horizontally oriented, peripherally projecting segments adapted for complementary engagement with each other when the container is in sealed engagement; and the mating surfaces of the horizontally oriented, peripherally projecting segments defining a horizontal seal zone when the container is in sealed engagement.

3. The container of claim 2 wherein the one or more vent channels define an area of complete discontinuity across the width of the horizontal seal zone.

4. The container of claim 1 wherein the lid of the container is adapted to remain engaged to the base, but allow the egress of gases and vapors inside the sealed container through the one or more vent channels upon the pressure in the sealed container reaching a certain level without repositioning of the lid on the base.

5. The container of claim 1 wherein the container has a plurality of vent channels that are equally spaced on the lid rim.

6. The plastic food container of claim 1 wherein:

the downwardly descending retaining bead is formed from a lid rim inner wall, a lid rim horizontally oriented, peripherally projecting segment and a lid rim outer wall, the lid rim outer wall being canted;

the base rim includes a base rim inner wall, a base rim horizontally oriented, peripherally projecting segment and a base rim outer wall, the base rim inner wall being canted; and when the container is in sealed engagement, the canted lid rim outer wall frictionally engages the canted base rim inner wall.

7. A plastic food container comprising:

a base and a lid;

the base having a base rim and the lid having a lid rim;

the base rim and lid rim adapted for sealing engagement with each other;

the base rim having an inner wall and an outer wall and the lid rim having an inner wall and outer wall;

the base rim inner wall and the lid rim outer wall each having a mating surface;

the mating surfaces of the base rim inner wall and the lid rim outer wall being adapted for complementary engagement with each other when the container is in sealed engagement;

the mating surfaces when engaged creating a first vertical seal zone extending around the periphery of the container, the first vertical seal zone having a width defined by the engaged mating surfaces when the container is in the sealed arrangement;

one or more vent channels disposed on the lid rim or base rim and extending upwardly and partially into the width of the first vertical seal zone, each of the one or more vent channels defining an area of partial peripheral discontinuity of the first vertical seal zone where the mating surfaces of the base rim inner wall and lid rim outer wall do not contact each other when the container is in sealed engagement;

the mating surfaces when engaged also creating a second vertical seal zone, the second vertical seal zone constituting a portion of the first vertical seal zone; and the second vertical seal zone being continuous about the periphery of the container and being defined by the portion of the width of the first vertical seal zone located above the one or more vent channels.

8. The plastic food container of claim 7 wherein:

the lid rim outer wall and base rim inner wall are canted; and when the container is in sealed engagement, the canted lid rim outer wall frictionally engages the canted base rim inner wall.

9. The container of claim 8 further comprising:

the base rim and lid rim each having a horizontally oriented, peripherally projecting segment;

the horizontally oriented, peripherally projecting segments of the base rim and lid rim each having a mating surface;

the mating surfaces of the horizontally oriented, peripherally projecting segments adapted for complementary engagement with each other when the container is in sealed engagement; and the mating surfaces of the horizontally oriented, peripherally projecting segments defining a horizontal seal zone when the container is in sealed engagement.

10. The container of claim 9 wherein the one or more vent channels define an area of complete discontinuity across the width of the horizontal seal zone.

11. The container of claim 8 wherein the lid of the container is adapted to remain engaged to the base, but allow the egress of gases and vapors inside the sealed container through the one or more vent channels upon the pressure in the sealed container reaching a certain level.

12. The plastic food container of claim 7 wherein:

the lid rim outer wall and base rim inner wall are canted; and when the container is in sealed engagement, the canted lid rim inner wall frictionally engages the canted base rim outer wall.

13. A plastic food container comprising:

a base and a lid, the base having a base rim and the lid having a lid rim and an upper portion;

the base rim having a base rim inner wall, a base rim horizontally oriented, peripherally projecting segment and a base rim outer wall;

the lid rim having a lid rim inner wall, a horizontally oriented, peripherally projecting segment and a lid rim outer wall, the lid rim inner wall, the horizontally oriented peripherally projecting segment and the lid rim vertically oriented outer wall forming a downwardly descending bead;

the base rim and lid rim adapted for sealing engagement with each other in which the downwardly descending bead of the lid snap fits within and is frictionally held by the base rim inner wall by virtue of that snap fit;

the base rim inner wall and lid rim outer wall each having a mating surface, the mating surfaces of the base rim inner wall and the lid rim outer wall adapted for complementary engagement with each other when the container is in sealed engagement and the mating surfaces when engaged creating a first vertical seal zone extending around the periphery of the container, the first vertical seal zone having a width defined by the engaged mating surfaces when the container is in sealed engagement;

the horizontally oriented peripherally projecting segments of the base rim and lid rim each having a mating surface, the mating surfaces of the horizontally oriented, peripherally projecting segments adapted for complementary engagement with each other when the container is in sealed engagement and the mating surfaces of the horizontally oriented, peripherally projecting segments defining a horizontal seal zone when the container is in sealed engagement;

one or more vent channels disposed on the lid rim or base rim, the one or more vent channels defining define an area of complete discontinuity across the width of the horizontal seal zone and extending upwardly and partially into the width of the first vertical seal zone, each of the one or more vent channels defining an area of partial peripheral discontinuity of the first vertical seal zone where the mating surfaces of the base rim inner wall and lid rim outer wall do not contact each other when the container is in sealed engagement;

the mating surfaces of the base rim inner wall and the lid rim outer wall when engaged also creating a second vertical seal zone, the second vertical seal zone constituting a portion of the first vertical seal zone; and the second vertical seal zone being continuous about the periphery of the container and being defined by the portion of the width of the first vertical seal zone located above the one or more vent channels.

* * * * *

UNITED STATES PATENT AND TRADEMARK OFFICE

CERTIFICATE OF CORRECTION

PATENT NO. : 8,875,927 B2
APPLICATION NO. : 12/565515
DATED : November 4, 2014
INVENTOR(S) : Mike Pholman et al.

It is certified that error appears in the above-identified patent and that said Letters Patent is hereby corrected as shown below:

In the Drawings

The drawing sheets 6 and 11 consisting of fig(s) 6 and 11 should be deleted and substitute therefore drawing sheets 6 and 11 consisting of fig(s) 6 and 11 as shown on the attached pages 2-3.

Signed and Sealed this
Seventeenth Day of February, 2015

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,875,927 B2
APPLICATION NO. : 12/565515
DATED : November 4, 2014
INVENTOR(S) : Mike Pohlman et al.

It is certified that error appears in the above-identified patent and that said Letters Patent is hereby corrected as shown below:

In the Drawings

The drawing sheets 6 and 11 consisting of fig(s) 6 and 11 should be deleted and substitute therefore drawing sheets 6 and 11 consisting of fig(s) 6 and 11 as shown on the attached pages 2-3.

This certificate supersedes the Certificate of Correction issued February 17, 2015.

Signed and Sealed this
Fifth Day of May, 2015

Michelle K. Lee

Michelle K. Lee
*Director of the United States Patent and Trademark Office*